US010644414B2

(12) United States Patent
Kanemura et al.

(10) Patent No.: US 10,644,414 B2
(45) Date of Patent: May 5, 2020

(54) TERMINAL FITTING AND CONNECTOR

(71) Applicant: Sumitomo Wiring Systems, Ltd., Yokkaichi, Mie (JP)

(72) Inventors: Keisuke Kanemura, Mie (JP); Shohei Mitsui, Mie (JP); Hidekazu Matsuda, Mie (JP); Yuichi Nakanishi, Mie (JP); Ai Hirano, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/231,675

(22) Filed: Dec. 24, 2018

(65) Prior Publication Data

US 2019/0199006 A1 Jun. 27, 2019

(30) Foreign Application Priority Data

Dec. 26, 2017 (JP) ..... 2017-248732

(51) Int. Cl.

| | |
|---|---|
| ***H01R 4/18*** | (2006.01) |
| ***H01R 13/6583*** | (2011.01) |
| ***H01R 9/05*** | (2006.01) |
| ***H01R 43/16*** | (2006.01) |
| ***H01R 4/20*** | (2006.01) |
| *H01R 13/11* | (2006.01) |
| *H01R 13/24* | (2006.01) |

(52) U.S. Cl.

CPC ..... *H01R 4/184* (2013.01); *H01R 4/20* (2013.01); *H01R 9/0518* (2013.01); *H01R 13/6583* (2013.01); *H01R 43/16* (2013.01); *H01R 13/113* (2013.01); *H01R 13/2435* (2013.01)

(58) Field of Classification Search

CPC ..... H01R 9/05; H01R 4/184

See application file for complete search history.

(56) References Cited

U.S. PATENT DOCUMENTS

| | | | | |
|---|---|---|---|---|
| 5,518,421 A * | 5/1996 | Davis | ..... | H01R 13/506 439/607.5 |
| 5,725,395 A * | 3/1998 | Lee | ..... | H01R 13/504 439/108 |
| 6,200,162 B1 * | 3/2001 | Aoyama | ..... | H01R 4/184 439/578 |

(Continued)

FOREIGN PATENT DOCUMENTS

| | | |
|---|---|---|
| JP | 2606411 | 11/2000 |

*Primary Examiner* — Ross N Gushi

(74) *Attorney, Agent, or Firm* — Gerald E. Hespos; Michael J. Porco; Matthew T. Hespos

(57) ABSTRACT

A terminal fitting (T) includes an inner conductor (11) and an outer conductor (12). The inner conductor (11) has a mating connecting portion (15) to be connected to a mating terminal fitting and a center conductor crimping portion (16) to be crimped to a center conductor of a shielded cable. The outer conductor (12) has a tubular portion (19) configured to surround the mating connecting portion (15). A coupling (21) is behind the tubular portion (19). The center conductor crimping portion is inside the coupling (21). A shield crimping portion (22) is behind the coupling (21) and is to be crimped to a shield layer of the shielded cable. A conductive member (60) extends in a front-rear direction and includes a bridge (61) to electrically contact the tubular portion (19) and the shield crimping portion (22) across the coupling (21).

7 Claims, 4 Drawing Sheets

(56) References Cited

U.S. PATENT DOCUMENTS 6,384,335 B1 * 5/2002 Saito ..... H01R 9/0518 174/74 R
6,659,801 B2 * 12/2003 Nishio ..... H01R 13/6581 439/607.48
6,709,290 B2 * 3/2004 Yoshida ..... H01R 9/0518 439/585
6,808,417 B2 * 10/2004 Yoshida ..... H01R 9/0518 439/585
7,160,150 B2 * 1/2007 Annequin ..... H01R 43/048 439/585
7,422,480 B1 * 9/2008 Musick ..... H01R 9/0518 439/585
7,465,194 B1 * 12/2008 Ho ..... H01R 9/032 439/607.01
7,632,155 B1 * 12/2009 Wu ..... H01R 9/035 439/497
7,909,647 B2 * 3/2011 Kawaguchi ..... H01R 9/035 439/585
8,079,870 B2 * 12/2011 Nakamura ..... H01R 9/0518 439/585
8,366,483 B2 * 2/2013 Hardy ..... H01R 9/0518 439/578
8,777,665 B2 * 7/2014 Ii ..... H01R 13/6593 439/607.27
8,870,596 B2 * 10/2014 Ii ..... H01R 13/6581 439/607.41
9,531,132 B2 * 12/2016 Iwamoto ..... H01R 13/6581
9,960,504 B2 * 5/2018 Hikosaka ..... H01R 9/0518
10,027,073 B2 * 7/2018 Tokita ..... H01R 24/38
10,312,605 B2 * 6/2019 Hamada ..... H01R 9/0518
2010/0136832 A1 * 6/2010 Kawaguchi ..... H01R 9/035 439/607.03
2013/0023155 A1 * 1/2013 Ii ..... H01R 13/6593 439/607.27
2013/0171873 A1 * 7/2013 Kanda ..... H01R 13/6581 439/607.51
2016/0093983 A1 * 3/2016 Tanaka ..... H01R 13/6593 439/607.55
2016/0093984 A1 * 3/2016 Iwamoto ..... H01R 13/6581 439/607.55
2019/0199006 A1 * 6/2019 Kanemura ..... H01R 4/184
2019/0199008 A1 * 6/2019 Kanemura ..... H01R 13/4223
2019/0199013 A1 * 6/2019 Kanemura ..... H01R 13/6581
2019/0199014 A1 * 6/2019 Kanemura ..... H01R 13/113
2019/0199036 A1 * 6/2019 Kanemura ..... H01R 13/50

* cited by examiner

TERMINAL FITTING AND CONNECTOR

BACKGROUND

Field of the Invention

The invention relates to a terminal fitting and a connector.

Related Art

A high-frequency compatible shielded cable is routed in an automotive vehicle to transmit a high-frequency signal to a circuit board of an electrical device, such as a television or car navigation system mounted in the vehicle. For example, Japanese Utility Model No. 2606411 discloses a shielded cable known as a hollow cable. This hollow cable is connected to an electrical contact terminal that includes a shielding outer tube. The shielding outer tube includes a contact holding portion and an outer conductor crimping portion located behind the contact holding portion. A tool insertion opening vertically penetrates through the contact holding portion. A center conductor contact is accommodated in the shielding outer tube via an insulator. The center conductor contact includes a center conductor crimping portion. The hollow cable is mounted on the electrical contact terminal from above. A center conductor exposed on a tip part of the hollow cable is placed on the center conductor crimping portion, and an outer conductor of the hollow cable is placed on the outer conductor crimping portion. In that state, an anvil and a crimper, serving as crimping tools for the center conductor contact, are inserted into the tool insertion opening to deform the center conductor crimping portion and crimp the center conductor crimping portion to the center conductor. Further, an anvil and a crimper serving as crimping tools for the shielding outer tube deform the outer conductor crimping portion and crimp the outer conductor crimping portion to the outer conductor. In this way, the hollow cable is connected to the electrical contact terminal.

The shielding outer tube is formed with a vertically open part such as the tool insertion opening and this open part is not covered. Thus, a shield current may not flow smoothly. Further, without limitation to the above case, an opening or a recess often is provided at a position corresponding to a contact holding portion in a terminal fitting to be connected to a shielded cable, leading to a problem of degraded shielding performance.

The invention was completed on the basis of the above situation and aims to provide a terminal fitting capable of improving shielding performance.

SUMMARY

The invention is directed to a terminal fitting with an inner conductor including a mating connecting portion to be connected to a mating terminal fitting and a center conductor crimping portion to be crimped to a center conductor of a shielded cable. The terminal fitting includes an outer conductor with a tubular portion configured to surround the mating connecting portion. A coupling is located behind the tubular portion. The center conductor crimping portion is disposed inside the coupling. A shield crimping portion is located behind the coupling and is to be crimped to a shield layer of the shielded cable. A conductive member extends in a front-rear direction and includes a bridge configured to electrically contact the tubular portion and the shield crimping portion across the coupling.

An opening or recess in the coupling may result in a shield current not flowing smoothly between the tubular portion and the shield crimping portion. However, the bridge of the conductive member electrically contacts the tubular portion and the shield crimping portion across the coupling in the above-described configuration. Thus, a shield current flows satisfactorily between the tubular portion and the shield crimping portion, and shielding performance can be improved.

The conductive member may include a grounding portion connected to the bridge. Since the conductive member includes the grounding portion, a current can be discharged to ground and a dedicated grounding portion need not be provided. As a result, the number of components can be reduced.

The terminal fitting may be accommodated in a housing of a connector. The bridge may electrically contact the tubular portion and the shield crimping portion inside the housing. According to this configuration, a contact state of the bridge with the tubular portion and the shield crimping portion is maintained satisfactorily.

DETAILED DESCRIPTION

Figure 1:
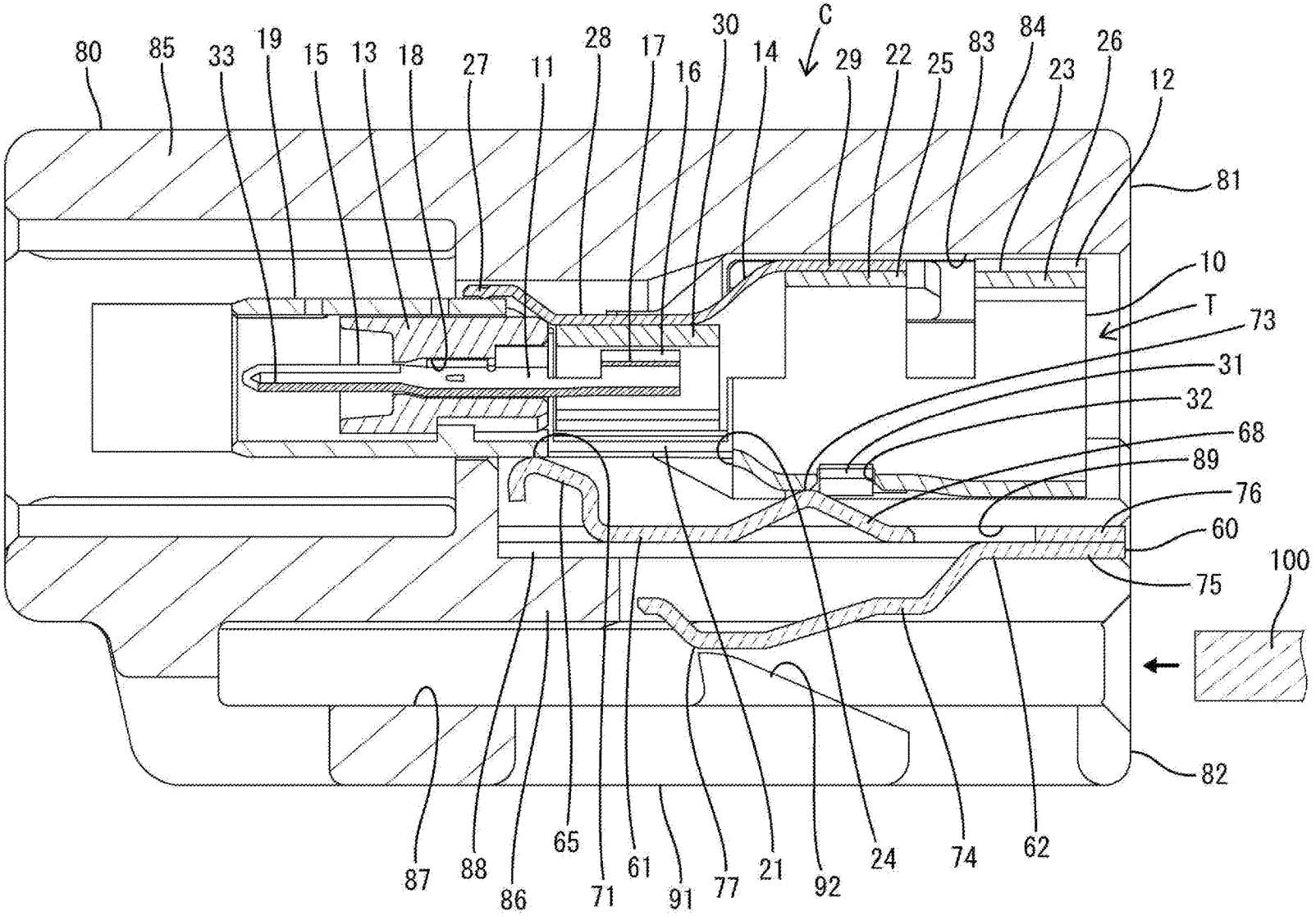
FIG. 1 is a section of a terminal fitting and a housing of an embodiment of the invention.

An embodiment is described with reference to FIGS. 1 to 4. As shown in FIG. 1, a terminal fitting T includes a terminal body 10 formed by integrally assembling an inner conductor 11, an outer conductor 12, a dielectric 13 and a cover 14, and a conductive member 60. Although not shown, the terminal body 10 is connected to an end part of a shielded cable W and accommodated into a housing 80 of a connector C. The conductive member 60 is accommodated into the housing 80 and electrically contacts the outer conductor 12.

Figure 4:
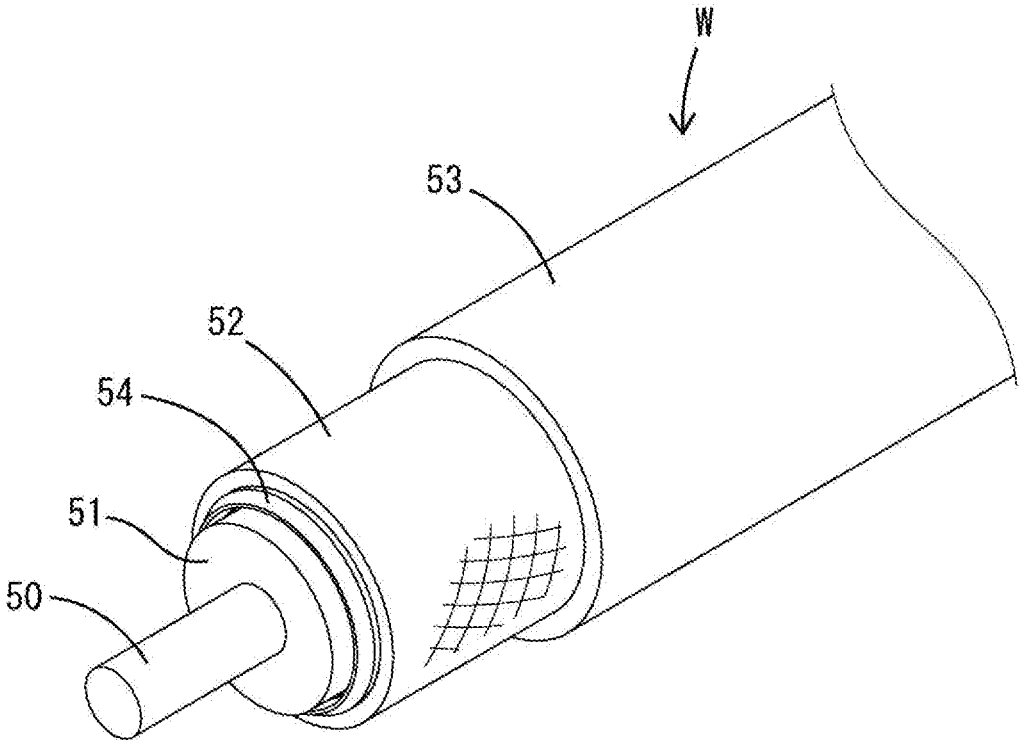
FIG. 4 is a perspective view of a shielded cable.

As shown in FIG. 4, the shielded cable W is a so-called coaxial cable and includes a conductive core 50 (center conductor) formed by twisting strands, an insulating coating 51 surrounding the core 50, a conductive braided wire 52 (shield layer) surrounding the outer periphery of the coating 51 and formed by weaving strands into a net and an insulating sheath 53 surrounding the outer periphery of the braided wire 52. The core 50 has a function of transmitting a high-frequency signal and the braided wire 52 has a function of shielding electromagnetic waves. The shielded cable W has the sheath 53 and the coating 51 stripped successively to expose the core 50 and the braided wire 52 from a tip side. A sleeve 54 for receiving a crimping load is inserted between the coating 51 and the braided wire 52.

The inner conductor 11 is formed such as by bending a conductive metal plate into a shape that is long and narrow in a front-rear direction. As shown in FIG. 1, the inner conductor 11 includes a mating connecting portion 15 on a front part and a center conductor crimping portion 16 on a rear part. The mating connecting portion 15 includes a tab 33 projecting toward a leading side (forward). The tab 33 electrically contacts a contact point portion of an unillustrated mating terminal fitting.

The center conductor crimping portion 16 includes a center conductor crimping piece 17 in the form of an open barrel. Although not shown, the center conductor crimping piece 17 is crimped and connected to the core 50 of the shielded cable W.

The dielectric 13 is made of synthetic resin, has a tubular shape and includes, as shown in FIG. 1, an inner conductor insertion hole 18 penetrating in the front-rear direction. A front part of the inner conductor 11 including the mating connecting portion 15 is inserted into the inner conductor insertion hole 18 of the dielectric 13 to be held therein.

The outer conductor 12 is one size larger than the inner conductor 11, and may be formed by bending a conductive metal plate. The outer conductor 12 has a tubular portion 19, a coupling 21, a shield crimping portion 22 and a sheath crimping portion 23 from a front end to a rear end, as shown in FIG. 1.

The tubular portion 19 has a hollow cylindrical shape and the dielectric 13 is inserted and held inside. A tip part of the tubular portion 19 surrounds a tip part of the tab 33. When the housing 80 and a mating housing are connected, a dielectric of the unillustrated mating terminal fitting is arranged on an inner peripheral side and an outer conductor of the unillustrated mating terminal fitting is arranged on an outer peripheral side. The tubular portion 19 electrically contacts the outer conductor of the mating terminal fitting.

As shown in FIG. 1, the coupling 21 includes an opening 24 in a wall linking the tubular portion 19 and the shield crimping portion 22. Unillustrated crimping tools (anvil, crimper) for the center conductor crimping portion 16 of the inner conductor 11 are inserted into the opening 24. The coupling 21 with the opening 24 enables an operation of crimping and connecting the center conductor crimping portion 16 to the core 50 of the shielded cable W to be performed after the inner conductor 11 is in the outer conductor 12.

The shield crimping portion 22 includes a shield crimping piece 25 in the form of an open barrel. Further, the sheath crimping portion 23 includes a sheath crimping piece 26 in the form of an open barrel and projecting in the same direction as the shield crimping piece 25. Although not shown, the shield crimping piece 25 is crimped and connected to the braided wire 52 of the shielded cable W, and the sheath crimping piece 26 is crimped and connected to the sheath 53 of the shielded cable W.

Figure 3:
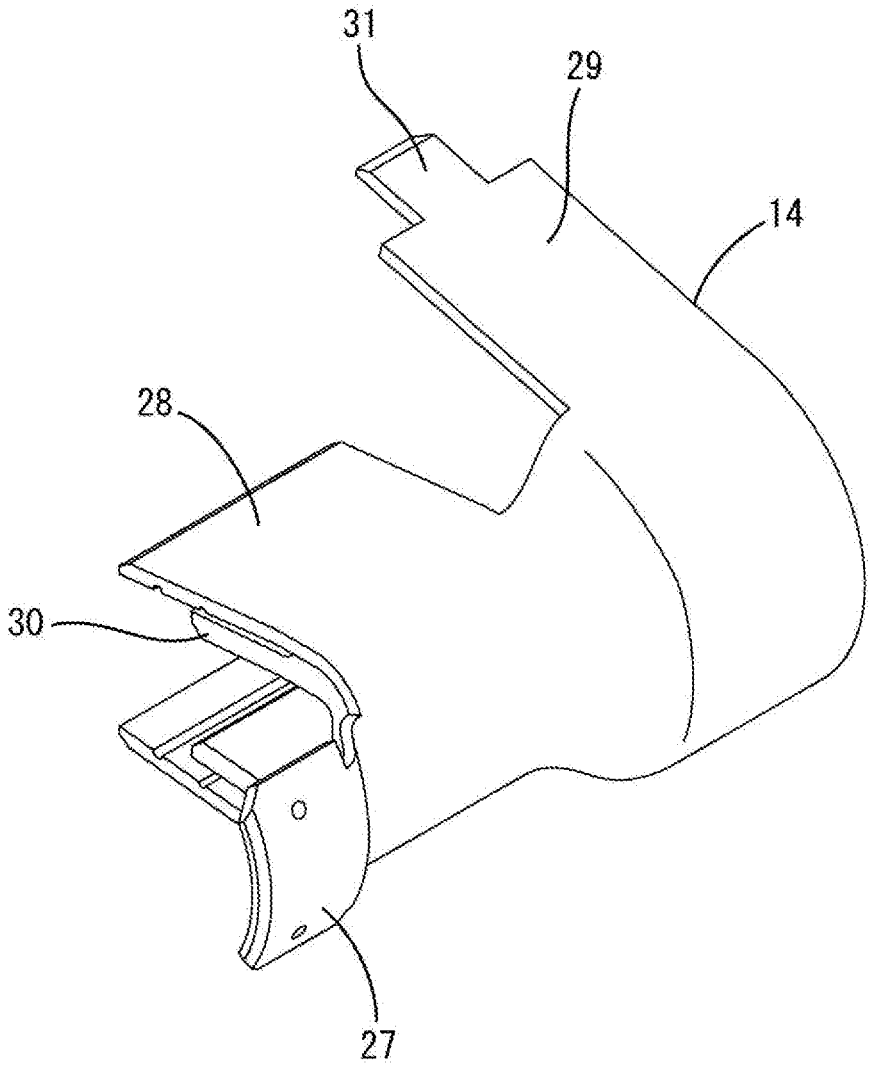
FIG. 3 is a perspective view of a cover member.

As shown in FIG. 3, the cover 14 has a connecting piece 27, an inner conductor-side surrounding portion 28 and a shield-side surrounding portion 29 successively connected from a front end to a rear end. As shown in FIG. 1, the inner conductor-side surrounding portion 28 is arranged inside the coupling 21 to surround the center conductor crimping portion 16. The connecting piece portion 27 is supported in contact with the upper end of the outer peripheral surface of the tubular portion 19. An insulating surrounding portion 30 made of synthetic resin is provided between the inner conductor-side surrounding portion 28 and the center conductor crimping portion 16.

The shield-side surrounding portion 29 is bent to have a substantially circular cross-sectional shape along the outer periphery of the shield crimping portion 22, and a locking piece 31 on a tip side is locked to a locking hole 32 of the shield crimping portion 22, as shown in FIG. 1, in a state where the shield-side surrounding portion 29 is surrounding the shield crimping portion 22. This shield-side surrounding portion 29 restricts inadvertent expansion of the shield crimping portion 22 gently crimped to the braided wire 52.

The cover 1 is configured so that a shield current flows in the front-rear direction by the connecting piece 27 electrically contacting the tubular portion 19, the shield-side surrounding portion 29 electrically contacting the shield crimping portion 22 and the inner conductor-side surrounding portion 28 covering the opening 24 of the coupling 21. By interposing the insulating surrounding portion 30 between the inner conductor-side surrounding portion 28 and the center conductor crimping portion 16, the occurrence of a short circuit between the inner and outer conductors 11, 12 can be prevented.

Figure 2:
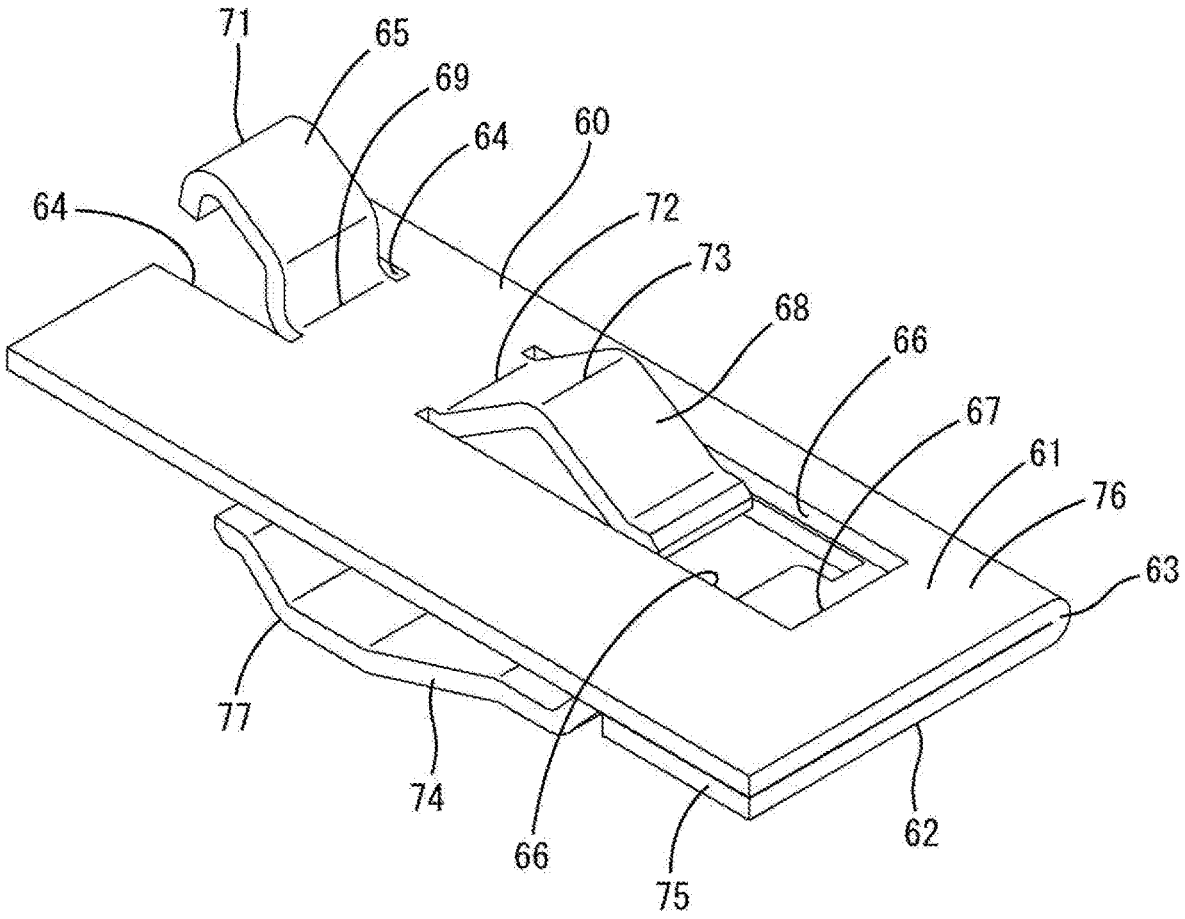
FIG. 2 is a perspective view of a conductive member.

The conductive member 60 is formed of a conductive metal plate and has a double plate structure by folding a single flat plate. As shown in FIG. 2, the conductive member 60 includes an upper plate 61 (bridge) in the form of a rectangular plate, a lower plate 62 (grounding portion) held substantially in close contact with the lower surface of the upper plate 61 and a folded portion 63 constituting one side edge along the front-rear direction of each of the upper and the lower plates 61, 62 and linking the upper and lower plates 61, 62.

The upper plate 61 has a front contact piece 65 and a rear contact piece 68. The front contact piece 65 is formed by bending a tongue between two cuts 64 that open up in a front edge and that extend in the front-rear direction. The rear contact piece 68 is behind the front contact piece 65 and is formed by bending a tongue defined by two parallel cuts 66 extending in the front-rear direction and a cut 67 extending in a lateral direction between the rear ends of the cuts 66. The front and rear contact pieces 65, 68 have substantially the same width and are arranged substantially at the same position in the lateral direction.

The front contact piece 65 is a cantilever rising from a part (rising base end 69) of the upper plate 61 between the rear ends of the cuts 64 on the front side, bent forward while rising up and further bent downward from a rising tip end. This front contact piece 65 is vertically deflectable and deformable with the rising base end 69 as a support. As shown in FIG. 1, the rising tip end of the front contact piece 65 is configured as a front contact 71 that resiliently contacts the tubular portion 19 of the outer conductor 12 from below.

As shown in FIG. 2, the rear contact piece 68 is a cantilever inclined up toward a rear side from a part (rising base end 72) of the upper plate 61 between the front ends of the cuts 66 on the rear side, reaching a top part, inclined downward toward the rear side from the top part, reaching a free end part, with the free end part extending substantially along the front-rear direction. This rear contact piece 68 is vertically deflectable and deformable with the rising base end 72 as a support. As shown in FIG. 1, the top of the rear contact piece 68 is configured as a rear contact 73 that resiliently contacts the shield crimping portion 22 of the outer conductor 12 from below. The rear contact 73 is below the front contact 71.

As shown in FIG. 2, the lower plate 62 is provided with a grounding contact piece 74 at a position opposite to the rear contact 68 of the upper plate 61. As shown in FIG. 1, the grounding contact 74 is cantilevered relatively steeply down toward a front end from a rear portion 75 of the lower plate 62, relatively gently inclined down in a stepwise manner, and inclined up toward the front from a lower end. The rear portion 75 of the lower plate 62 is held in close contact with a rear portion 76 of the upper plate 61.

The grounding contact piece 74 is vertically deflectable and deformable with the rear portion 75 of the lower plate 62 as a support, and is arranged substantially at the same position as the front and rear contact pieces 65, 68 in the lateral direction. The lower end part of the grounding contact 74 is configured as a grounding contact point 77 that resiliently contacts an external grounding member 100 (see FIG. 1) from above. The grounding contact point 77 is between the front and rear contacts 71, 73 in the front-rear direction.

The housing 80 is made of synthetic resin and includes, as shown in FIG. 1, a housing body 81 having a tubular shape long in the front-rear direction and a grounding member mounting portion 82 connected below a lower part of the housing body 81 via a separation wall 86.

The housing body 81 includes a terminal accommodating portion 84 having a cavity 83 penetrating in the front-rear direction, and a tubular receptacle 85 projecting forward from the front end of the terminal accommodating portion 84. The terminal body 10 is inserted into the cavity 83 of the terminal accommodating portion 84 from behind to be held therein. The tubular portion 19 of the outer conductor 12 except a rear end part is arranged to project into the receptacle 85. Further, the terminal accommodating portion 84 includes a communication hole 88 penetrating through the separation wall 86 and communicating with a rear part of the cavity 83 and a later-described grounding member insertion hole 87.

The conductive member 60 is inserted into the communication hole 88. The separation wall 86 includes mounting grooves 89 on both sides of the communication hole 88, and the both side edges of the upper and lower plate portions 61, 62 of the conductive member 60 are slid and inserted into the mounting grooves 89.

As shown in FIG. 1, the grounding member mounting portion 82 is long in the front-rear direction from the side of the receptacle 85 to the side of the terminal accommodating portion 84 and has a flat shape short in the vertical direction. This grounding member mounting portion 82 includes the slit-like grounding member insertion hole 87 extending in the front-rear direction and open in a rear surface. The grounding member 100 is inserted into the grounding member insertion hole 87 of the grounding member mounting portion 82 from behind. The grounding member mounting portion 82 includes a resilient locking portion 92 at a lower wall part, and the resilient locking portion 91 includes a claw portion 92 projecting toward the grounding member insertion hole 87 on a tip side. The grounding member 100 is retained and held in the grounding member insertion hole 87 by being locked by the claw portion 92 of the resilient locking portion 91.

The grounding member 100 includes a flat plate part fittable into the grounding member insertion hole 87, and is electrically connected to the terminal body 10 via the conductive member 60. The terminal fitting T is grounded via the grounding member 100.

Next, functions and effects of this embodiment are described.

In assembling, the terminal body 10 is inserted into the cavity 83 of the terminal accommodating portion 84 from behind to be held therein as shown in FIG. 1. Any of the rear end part of the tubular portion 19, the coupling portion 21, the shield crimping portion 22 and the sheath crimping portion 23 is arranged to face the communication hole 88.

Subsequently, the conductive member 60 is inserted into the communication hole 88 of the terminal accommodating portion 84 from behind to be held therein. When the conductive member 60 is inserted into the communication hole 88, the grounding contact piece 74 is inclined downward toward the front side in the communication hole 88 and the grounding contact point portion 77 is arranged to enter the grounding member insertion hole 87.

Further, the front contact piece 65 is inclined upward toward the front side in the communication hole 88, and the front contact point portion 71 enters the cavity 83 to contact the lower end of the outer peripheral surface of the tubular portion 19. Furthermore, the rear contact piece 68 is inclined upward toward the rear side in the communication hole 88, and the rear contact point portion 73 enters the cavity 83 to contact the lower end of the outer peripheral surface of the shield crimping portion 22. With the front contact point portion 71 held in contact with the tubular portion 19, a resilient force of the front contact piece 65 is applied to the tubular portion 19. Similarly, with the rear contact point portion 73 held in contact with the shield crimping portion 22, a resilient force of the rear contact piece 68 is applied to the shield crimping portion 22.

An area of the upper plate portion 61 between the front contact point portion 71 and the rear contact point portion 73 is arranged across the opening 24 of the coupling portion 21 and the inner conductor-side surrounding portion 28 of the cover member 14. That is, the upper plate portion 61 is bridged between the tubular portion 19 and the shield crimping portion 22 via the front and rear contact point portions 71, 73.

If the upper plate portion 61 is not provided, the flow of a shield current may be impeded and shielding performance may be reduced by the presence of the opening 24 in the coupling portion 21. In that respect, since the upper plate portion 61 is bridged between the tubular portion 19 and the shield crimping portion 22 across the opening 24 of the coupling portion 21 in this embodiment, a shield current smoothly flows via the upper plate portion 61 and a reduction of shielding performance can be prevented even if the opening 24 is present in the coupling portion 21.

Thereafter, the grounding member 100 is inserted into the grounding member insertion hole 87 of the grounding member mounting portion 82 from behind to be held therein. Then, the grounding contact point portion 77 contacts the upper surface of the grounding member 100 and a resilient force of the grounding contact piece 74 is applied to the grounding member 100. Thus, a ground current efficiently flows through the shield crimping portion 22, the upper plate portion 61, the grounding contact piece 74 and the grounding member 100.

As described above, since the upper plate portion 61 of the conductive member 60 electrically contacts the tubular portion 19 and the shield crimping portion 22 across the coupling portion 21 according to this embodiment, a shield current satisfactorily flows between the tubular portion 19 and the shield crimping portion 22 and shielding performance can be improved.

Further, the conductive member 60 includes the lower plate portion 62 connected to the upper plate portion 61, and a current can be discharged to ground via the grounding contact piece 74 of the lower plate portion 62. In this case, since the conductive member 60 doubles as a grounding portion and a shielding portion, a dedicated grounding portion is not necessary and the number of components can be reduced.

Further, since areas of the conductive member 60 to be brought into contact with the tubular portion 19, the shield crimping portion 22 and the grounding member 100 are set in the housing 80 of the connector C, each contact state can be satisfactorily maintained.

Other embodiments are briefly described below.

The invention is applicable also when no opening is provided in a bottom part of the coupling. Since the coupling constitutes a recessed step between the tubular portion and the shield crimping portion also in this case, a merit of ensuring a smooth flow of a shield current by the bridge of the conductive member is large.

The inner conductor may be a female terminal having a mating connecting portion capable of resiliently contacting a mating tab. If the inner conductor is a female terminal, the receptacle can be omitted from the housing.

The conductive member does not necessarily constitute a grounding conductive portion. In that case, the lower plate can be omitted from the conductive member.

The cover member can be omitted from the terminal body.

LIST OF REFERENCE SIGNS

C . . . connector
T . . . terminal fitting
W . . . shielded cable
10 . . . terminal fitting
11 . . . inner conductor
12 . . . outer conductor
15 . . . mating connecting portion
16 . . . center conductor crimping portion
19 . . . tubular portion
21 . . . coupling
22 . . . shield crimping portion
60 . . . conductive member
61 . . . upper plate (bridge)
62 . . . lower plate (grounding portion)
71 . . . front contact point
73 . . . rear contact point
100 grounding member

What is claimed is:

1. A terminal fitting, comprising:

an inner conductor including a mating connecting portion to be connected to a mating terminal fitting and a center conductor crimping portion to be crimped to a center conductor of a shielded cable;

an outer conductor including a tubular portion configured to surround the mating connecting portion, a coupling located behind the tubular portion, the center conductor crimping portion being disposed inside the coupling, and a shield crimping portion located rearward of the coupling and to be crimped to a shield layer of the shielded cable; and a conductive member extending in a front-rear direction, the conductive member including a plate-shaped bridge having a front contact piece projecting from the bridge and electrically contacting the tubular portion at a position forward of the coupling, and a rear contact piece projecting from the bridge at a position rearward of the front contact piece and electrically contacting the shield crimping portion at a position rearward of the coupling, wherein the front contact piece is formed by bending a tongue between two cuts open in a front end of the bridge.

2. The terminal fitting of claim 1, wherein the conductive member includes a grounding portion connected to the bridge.

3. A connector, comprising a housing configured to accommodate the terminal fitting of claim 1, wherein the bridge electrically contacts the tubular portion and the shield crimping portion inside the housing.

4. The terminal fitting of claim 1, wherein the rear contact piece is formed by two parallel cuts formed in the bridge at positions between front and rear ends of the bridge, the rear contact piece being bent up between the two parallel cuts.

5. A terminal fitting, comprising:

an inner conductor including a mating connecting portion to be connected to a mating terminal fitting and a center conductor crimping portion to be crimped to a center conductor of a shielded cable;

an outer conductor including a tubular portion configured to surround the mating connecting portion, a coupling located behind the tubular portion, the center conductor crimping portion being disposed inside the coupling, and a shield crimping portion located rearward of the coupling and to be crimped to a shield layer of the shielded cable; and a conductive member extending in a front-rear direction, the conductive member including a plate-shaped bridge having a front contact piece projecting from the bridge and electrically contacting the tubular portion at a position forward of the coupling, and a rear contact piece projecting from the bridge at a position rearward of the front contact piece and electrically contacting the shield crimping portion at a position rearward of the coupling, wherein the rear contact piece is formed by two parallel cuts formed in the bridge at positions between front and rear ends of the bridge, the rear contact piece being bent up between the two parallel cuts.

6. The terminal fitting of claim 5, wherein the conductive member includes a grounding portion connected to the bridge.

7. A connector, comprising a housing configured to accommodate the terminal fitting of claim 5, wherein the bridge electrically contacts the tubular portion and the shield crimping portion inside the housing.

* * * * *